US010714027B1

(12) United States Patent
Bastani et al.

(10) Patent No.: US 10,714,027 B1
(45) Date of Patent: Jul. 14, 2020

(54) BACKLIGHT DRIVING MECHANISM FOR VIRTUAL REALITY

(71) Applicant: Google LLC, Mountain View, CA (US)

(72) Inventors: Behnam Bastani, San Jose, CA (US); Carlin Vieri, Menlo Park, CA (US)

(73) Assignee: GOOGLE LLC, Mountain View, CA (US)

( * ) Notice: Subject to any disclaimer, the term of this patent is extended or adjusted under 35 U.S.C. 154(b) by 23 days.

(21) Appl. No.: 16/000,204

(22) Filed: Jun. 5, 2018

Related U.S. Application Data

(60) Provisional application No. 62/515,062, filed on Jun. 5, 2017.

(51) Int. Cl.
*G09G 3/34* (2006.01)
*G09G 3/36* (2006.01)

(52) U.S. Cl.
CPC ..... *G09G 3/342* (2013.01); *G09G 3/36* (2013.01); *G09G 2310/04* (2013.01); *G09G 2320/0257* (2013.01); *G09G 2320/0626* (2013.01); *G09G 2340/0435* (2013.01); *G09G 2354/00* (2013.01)

(58) Field of Classification Search
CPC ..... G09G 3/342; G09G 3/36; G09G 2310/04; G09G 2354/00; G09G 2320/0626; G09G 2320/0257; G09G 2340/0435
See application file for complete search history.

(56) References Cited

U.S. PATENT DOCUMENTS

2008/0316303 A1* 12/2008 Chiu ..... G09G 3/003 348/51
2013/0027525 A1* 1/2013 Kitayama ..... G02B 27/2264 348/54
2014/0146251 A1* 5/2014 Lee ..... H04N 13/337 349/15
2015/0348327 A1* 12/2015 Zalewski ..... G06F 3/01 345/419
2016/0035136 A1* 2/2016 Sendai ..... G02B 27/0172 345/633

* cited by examiner

*Primary Examiner* — Aneeta Yodichkas
(74) *Attorney, Agent, or Firm* — Brake Hughes Bellermann LLP

(57) ABSTRACT

Head-mounted displays (HMDs) for virtual reality (VR) provide backlit illumination when the LCD rows corresponding to a non-dominant eye of the viewer are being updated. For example, when a human viewer operates a VR computer in the form of a smartphone with an LCD screen embedded in specialized goggles (e.g., Google Cardboard), the human viewer may specify that his/her right eye is dominant. In this case, the VR computer times the backlit illumination to be activated when the rows of LCD pixels in the field of view of the non-dominant, i.e., left, eye are being updated. When the rows of LCD pixels in the field of view of the dominant, i.e., right eye are being updated, the VR computer deactivates the backlit illumination.

15 Claims, 8 Drawing Sheets

BACKLIGHT DRIVING MECHANISM FOR VIRTUAL REALITY

CROSS-REFERENCE TO RELATED APPLICATION

This application is a nonprovisional of, and claims priority to, U.S. Patent Application No. 62/515,062, filed on Jun. 5, 2017, entitled "BACKLIGHT DRIVING MECHANISM FOR VIRTUAL REALITY," the disclosure of which is incorporated by reference herein in its entirety.

TECHNICAL FIELD

This description relates to improving refresh rate in LCD virtual reality displays.

BACKGROUND

Head-mounted displays (HMDs) provide an immersive experience for users in applications such as virtual reality (VR) and augmented reality (AR).

SUMMARY

In one general aspect, a method can include performing, by controlling circuitry of a processor configured to display video frames to a viewer via a plurality of rows of liquid crystal display (LCD) pixels, a LCD pixel row update operation on a first row of a first portion of rows of LCD pixels of the plurality of rows of LCD pixels, the LCD pixel update operation producing, for the first row, one of a first state configured to block light from LCD pixels of the first row and a second state configured to allow light into LCD pixels of the first row. The method can also include performing, by the controlling circuitry, an illumination operation on the first portion of the plurality of rows of LCD pixels and a second portion of the plurality of rows of LCD pixels, the second portion of the plurality of rows of LCD pixels being distinct from the first portion of the plurality of rows of LCD pixels, the illumination operation triggering a production of light for each of the plurality of rows of LCD pixels for an interval of time during which the first row is updated. The method can further include, after the interval of time, performing, by the controlling circuitry, the LCD pixel update operation on a second row of the second portion of rows of LCD pixels of the plurality of rows of LCD pixels.

The details of one or more implementations are set forth in the accompanying drawings and the description below. Other features will be apparent from the description and drawings, and from the claims.

DETAILED DESCRIPTION

Figure 1:
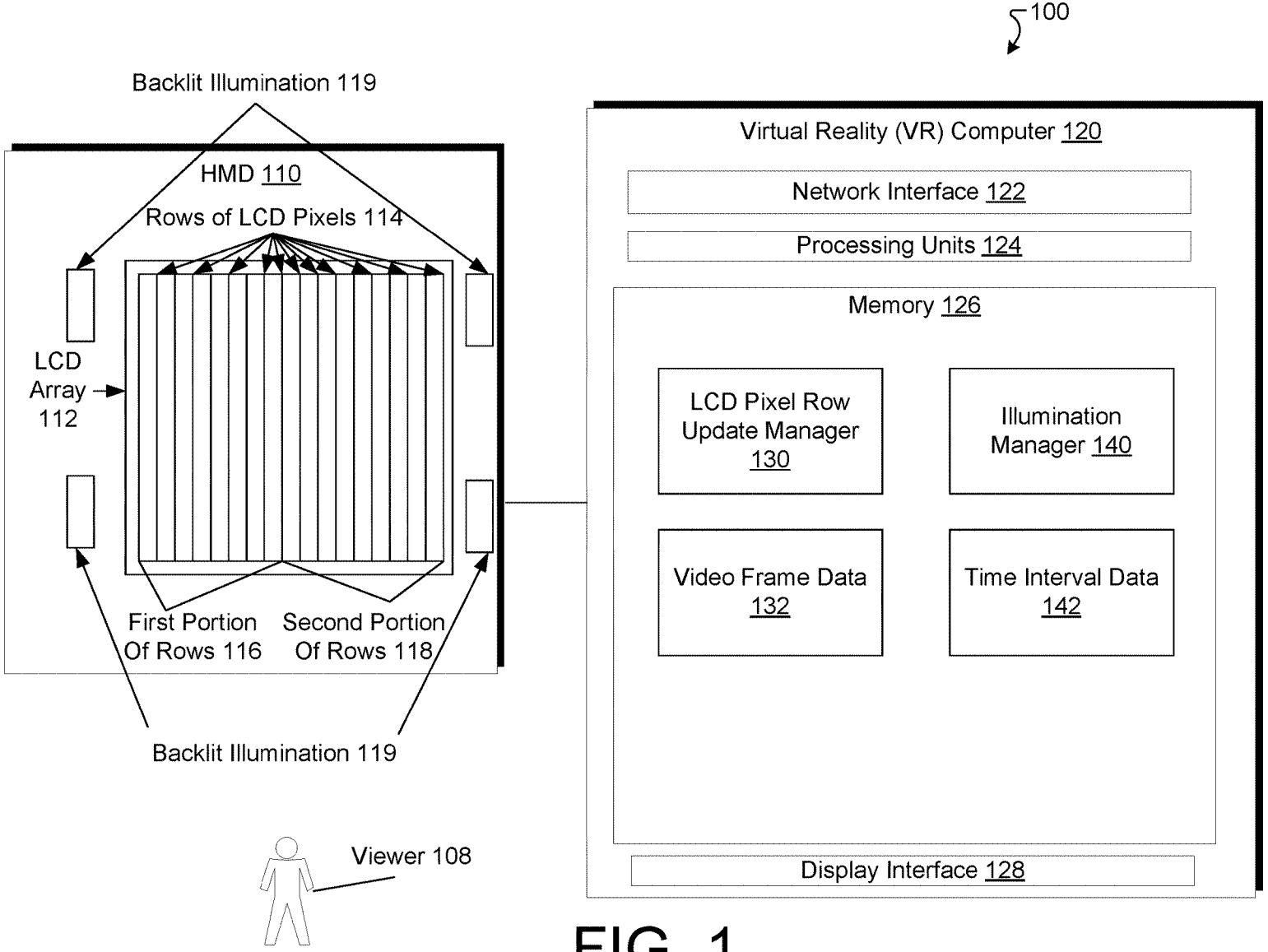
FIG. 1 is a diagram that illustrates an example electronic environment in which improved techniques described herein may be implemented.

Some HMDs may include a liquid-crystal display (LCD) panel. Some LCD panels include a pair of polarization filters, a pair of glass substrates, and a twisted nematic (TN) liquid crystal, in-plane switching (IPS), or fringe-field switching (FFS). The polarization filters are configured to pass through light from a global backlit illumination (e.g., LEDs) in a first polarization state and block light in a second polarization state. Each glass substrate provides, for each LCD pixel, electrodes across which a voltage (e.g., 5 V) may or may not be applied for that LCD pixel. As an example, the TN liquid crystal for a LCD pixel is configured to rotate or not rotate the polarization of light incident upon the LCD pixel by 90 degrees according to whether there is a voltage applied to the glass substrates. For example, the light from the backlit illumination may pass through the filter when no voltage is applied to the glass substrate for the LCD pixel, while no light will pass through the filter when the voltage is applied to the glass substrate for the LCD pixel. Application of the voltage to the glass substrates for a LCD pixel switches off light to that LCD pixel.

An LCD panel includes an array of LCD pixels, for example 1920×1080 pixels for high definition (HD). To prepare a display of a new frame, one row of the array of LCD pixels is updated at a time. That is, each liquid crystal for that LCD pixel in that row configures itself to allow or block light incident on that LCD pixel from a global backlit illumination that illuminates all LCD pixels in the array. In a conventional HMD, once all rows of the array of LCD pixels have been updated, the global backlit illumination is provided to display the updated array of LCD pixels in the HMD.

In the above-described conventional HMD, the LCDs can suffer from relatively low refresh rate due to their long settling time. Such a low or suboptimal refresh rate (or a long frame persistence) can degrade the user experience for VR. For example, in a LCD panel, each LC may or may not rotate within the liquid according to the applied voltage. Such a rotation occurs over a finite duration of time (e.g., 0.2-30 msec). In a conventional HMD, the global backlit illumination is provided when all of the LCD pixels have settled, i.e., when all of the LCs set to rotate have completed their rotations. Accordingly, the refresh rate of the HMD may be suboptimal due to this latency brought on by the time needed for the LCD pixels to settle.

One way to optimize the refresh rate of the HMD is to introduce the global backlit illumination during the time interval in which the LCD pixels are settling. Nevertheless, while such a scheme can optimize the refresh rate, the scheme results in unwanted ghosting. That is, the viewer will see, for a brief time, a remnant of a previous frame in some portions of the HMD. The ghosting may negatively affect the viewer experience.

In accordance with the implementations described herein, improved HMDs determine a phase of a short persistence global backlight illumination pulse avoid ghosting in displays for VR HMDs, especially during head movement. Specifically, such improved HMDs provide backlit illumination when the LCD rows corresponding to a non-dominant eye of the viewer are being updated. For example, when a human viewer operates a VR computer in the form of a smartphone with an LCD screen embedded in specialized goggles (e.g., Google Cardboard), the human viewer may specify that his/her right eye is dominant. In this case, the VR computer times the backlit illumination to be activated when the rows of LCD pixels in the field of view of the non-dominant, i.e., left, eye are being updated. When the rows of LCD pixels in the field of view of the dominant, i.e., right eye are being updated, the VR computer deactivates the backlit illumination.

Because a viewer will not see as well from his/her dominant eye, providing the illumination during the liquid crystal settling time interval corresponding to a non-dominant eye of the viewer will reduce perceived ghosting in displays for VR HMDs. Further, this elimination of perceived ghosting does not affect the refresh rate improvement gained by timing the activation of the backlit illumination to be while, rather than after, the updating and settling of the rows of LCD pixels. Further, even if improving the refresh rate is not a goal, providing adequate time for liquid crystal settling remains important.

FIG. 1 is a diagram that illustrates an example electronic environment 100 in which the above-described improved HMDs may be implemented. As shown, in FIG. 1, the electronic environment 100 includes a HMD 110 and a VR computer 120. As shown in FIG. 1, the HMD 110 is separate from the VR computer 120. In some implementations, such as the VR computer being a smartphone with an LCD screen, the HMD 110 is included within the VR computer 120.

The HMD 110 is configured to display high-resolution video frames to a human viewer 108 to provide an immersive VR experience. In some implementations, the HMD includes a pair of goggles that holds a smartphone with an LCD screen. In some implementations, the HMD 110 includes standalone goggles connected to (e.g., via a cable or a network connection) the VR computer 120. The HMD 110 includes a LCD array 112 and a backlit illumination 119.

The LCD array 112 is configured to arrange LCD pixels in rows 114 such that the LCD pixels will display a bright or dark image when the backlit illumination 119 is activated. For example, in some implementations, the LCD array 112 includes a pair of polarization filters, a pair of glass substrates, and for each LCD pixel, a twisted nematic (TN) liquid crystal. The polarization filters are configured to pass through light from a backlit illumination (e.g., LEDs) in a first polarization state and block light in a second polarization state. Each glass substrate provides, for each LCD pixel, electrodes across which a voltage (e.g., 5 V) may or may not be applied for that LCD pixel. The TN liquid crystal for a LCD pixel is configured to rotate or not rotate the polarization of light incident upon the LCD pixel by 90 degrees according to whether there is a voltage applied to the glass substrates. For example, the light from the backlit illumination may pass through the filter when no voltage is applied to the glass substrate for the LCD pixel, while no light will pass through the filter when the voltage is applied to the glass substrate for the LCD pixel. Application of the voltage to the glass substrates for a LCD pixel switches off light to that LCD pixel.

Figure 3:
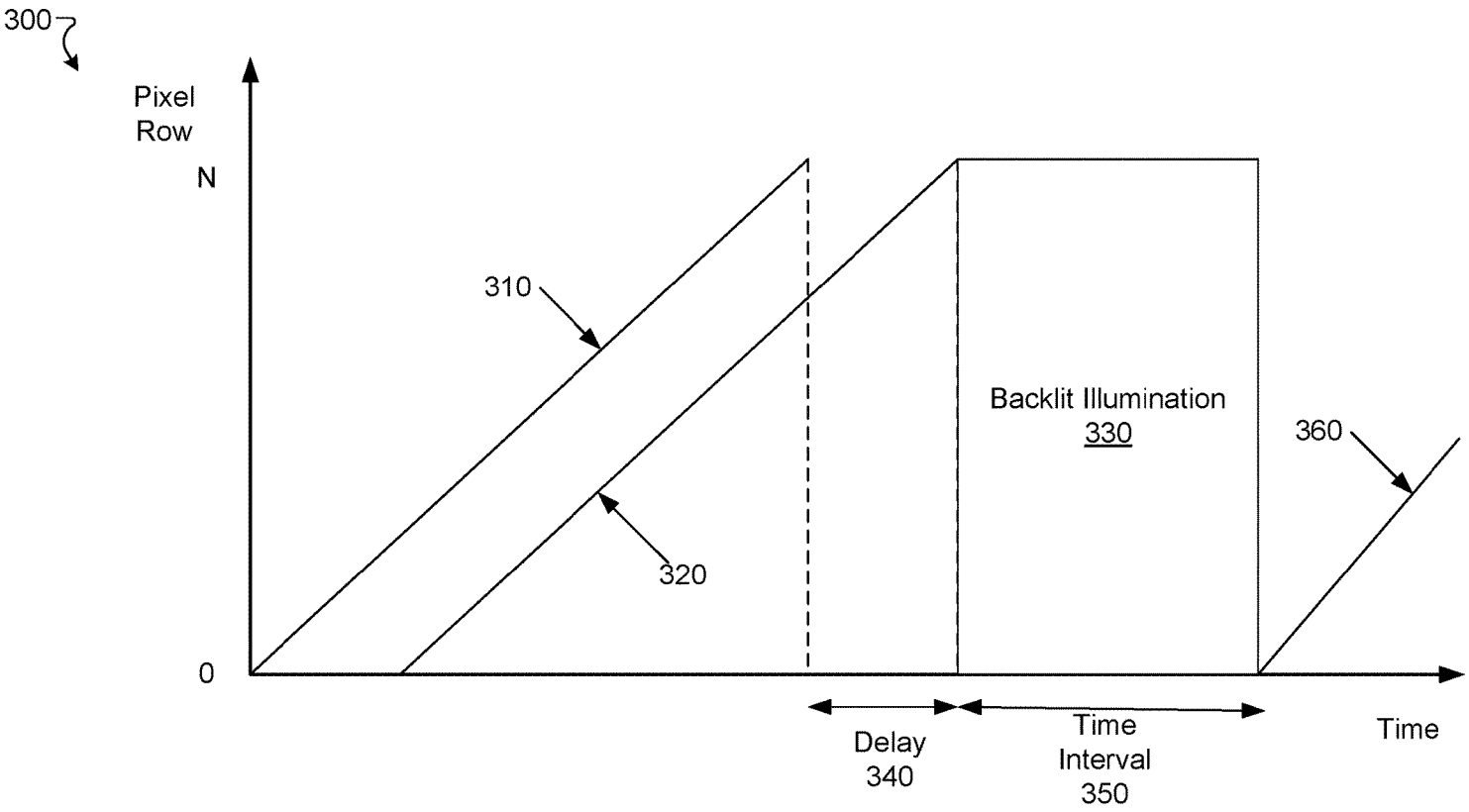
FIG. 3 is a diagram illustrating an example LCD settling time and its impact on refresh rate.

When the VR computer provides a new video frame to the HMD 110 for viewing, the VR computer 120 issues instructions to the HMD 110 to sequentially update the rows of LCD pixels 114, one row at a time by orienting the TN liquid crystals for the LCD pixels in that row as described above. For a 60 Hz refresh rate, the time needed to update all rows 114 of LCD pixels in an HD configuration (i.e., 1920×1080) is about 10-15 msec; in some implementations, this update time is close to 13 or 14 msec. Nevertheless, because each LCD pixel having a liquid crystal that needs to rotate in response to the new video frame takes a finite amount of time to effect that rotation, there is a liquid crystal settling time between 0.5 msec-30 msec (e.g., 20 msec) in addition to that nominal update time. Such settling time can seriously decrease the refresh rate when the backlit illumination 119 is not activated until all of the TN liquid crystals of the LCD pixels have settled. Such a scenario is illustrated in FIG. 3.

Figure 4:
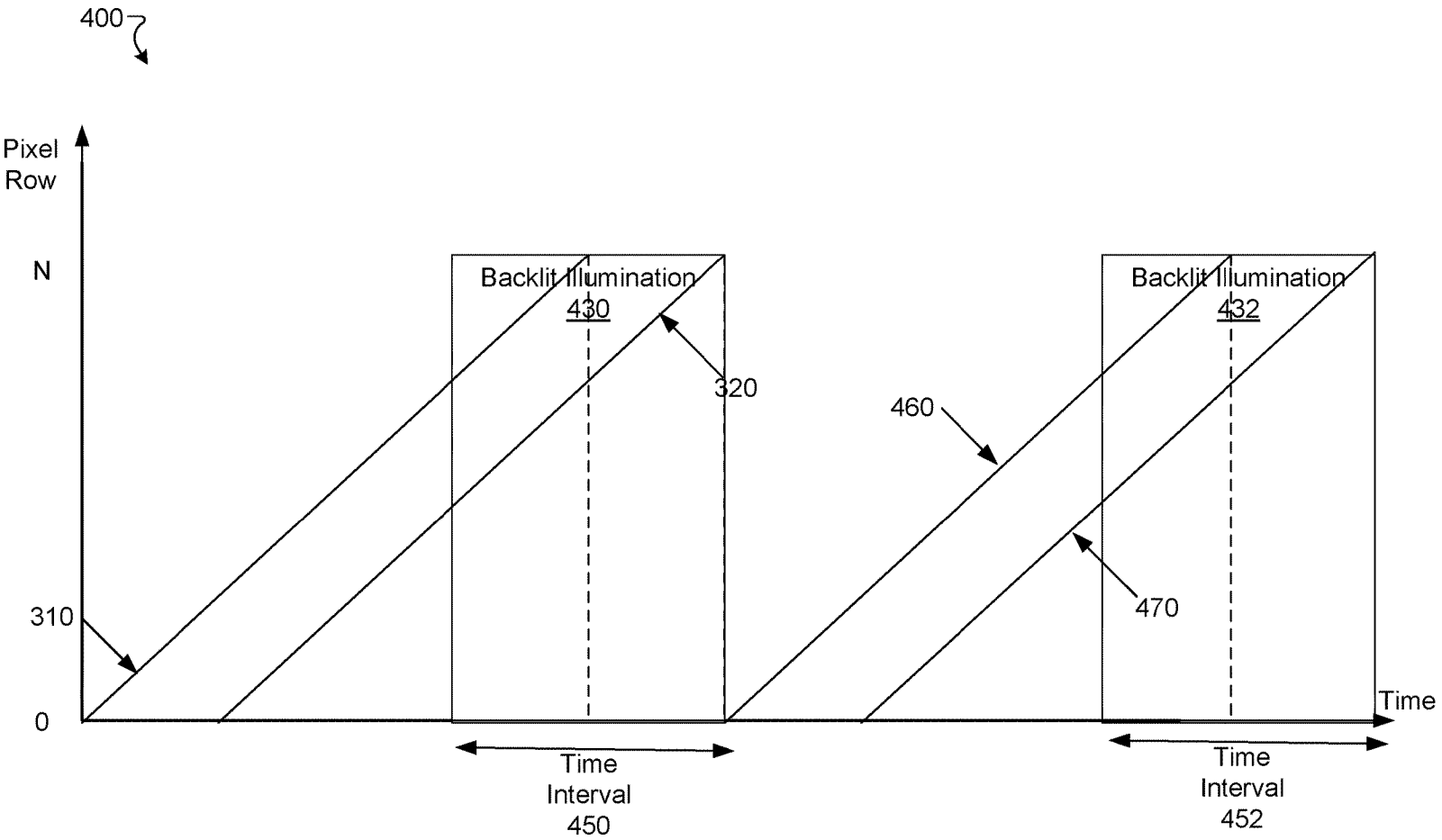
FIG. 4 is a diagram illustrating an example illumination scheme in which the refresh rate of an LCD configuration is improved at the expense of introducing ghosting.

One way to avoid such a reduction in the refresh rate is to activate the backlit illumination 119 while the rows 114 of LCD pixels are still settling. Such a scenario is illustrated in FIG. 4. Nevertheless, while the refresh rate in this scenario is improved over the previous scenario, ghosting in the resulting video image occurs. That is, the backlit illumination 119 is activated while the rows 114 of LCD pixels are updating. As a consequence, the viewer 108 may simultaneously see part of a current frame and part of a previous frame. It is the previous frame that manifests itself as a ghost image while illuminated.

To mitigate both problems of reduced refresh rate and ghosting, it is recognized that the viewer 108 has a dominant eye and a non-dominant eye, in which the majority of imaging capability lays with the dominant eye. Along these lines, the field of view (FOV) of the user is split into the FOV of the dominant eye and the FOV of the non-dominant eye. In many cases, the respective FOVs of the dominant and non-dominant eyes can cover complementary portions of the rows 114 of LCD pixels. That is, one eye has a FOV that covers a first portion of rows 116 and a second eye has a FOV that covers a second portion of rows 118. For example, when the viewer 108 is wearing goggles that hold a smartphone with an LCD display, a lens in the left eyehole of the goggles images the first portion of rows 116 onto the left eye of the viewer 108 and a lens in the right eyehole of the goggles images the second portion of rows 118 onto the right eye of the viewer 108.

Once the rows 114 have been divided in the fashion described above, the VR computer 120 may activate the backlit illumination 119 during the time when the first portion of rows 116 is being updated (i.e., when the non-dominant eye has a FOV covering the first portion 116). In this way, while there still may be a real ghosting effect, the ghosting is only being seen by the non-dominant eye and is in effect not being perceived by the user 108. This scenario is described further in FIG. 5.

The backlit illumination 119 is configured to provide light to each of the LCD pixels in all rows 114 at the same time. In some implementations, the backlit illumination includes LEDs. In some implementations, the LEDs are distributed to provide optimally uniform illumination to all of the LCD pixels in all rows 114.

The VR computer 120 is configured to provide video frames to the LCD array 112. The VR computer 120 includes a network interface 122, one or more processing units 124, and memory 126. The network interface 122 includes, for example, Ethernet adaptors, Token Ring adaptors, and the like, for converting electronic and/or optical signals to electronic form for use by the VR computer 120. The set of processing units 124 include one or more processing chips and/or assemblies. The memory 126 includes both volatile memory (e.g., RAM) and non-volatile memory, such as one or more ROMs, disk drives, solid state drives, and the like. The set of processing units 124 and the memory 126 together form control circuitry, which is configured and arranged to carry out various methods and functions as described herein.

In some embodiments, one or more of the components of the VR computer 120 can be, or can include processors (e.g., processing units 124) configured to process instructions stored in the memory 126. Examples of such instructions as depicted in FIG. 1 include a LCD pixel row update manager 130 and an illumination manager 140. Further, as illustrated in FIG. 1, the memory 126 is configured to store various data, which is described with respect to the respective managers that use such data.

The LCD pixel row update manager 130 is configured to provide video frame data 132 to the LCD array 112 over the display interface 128 for sequentially updating the rows 114 of the LCD array 112. Each video frame of the video frame data 132 includes data representing an array of pixels. In some implementations, the number of pixels in such a video frame has the same number of LCD pixels in the LCD array 112. In some implementations, the number of pixels in such a video frame has a different number of LCD pixels in the LCD array 112. In such a case, the LCD pixel row update manager 130 is configured to interpolate the video frame data 132 such that each video frame has the same number of LCD pixels in the LCD array 112. The updating process is as described above.

The illumination manager 140 is configured to activate the backlit illumination 119 over an interval of time indicated by the time interval data 142. The time interval data 142 includes a beginning time and an end time. The beginning time and end time are determined such that perceived ghosting by the viewer 108 is minimized. As described above, in some implementations the end time is aligned with the time at which the updating of the first portion of rows 116 has been completed. In some implementations, the beginning time is configured to provide sufficient brightness for the viewer 108 to see the image of the video frame with sufficient clarity, i.e., minimal blur.

The components (e.g., modules, processing units 124) of the user device 120 can be configured to operate based on one or more platforms (e.g., one or more similar or different platforms) that can include one or more types of hardware, software, firmware, operating systems, runtime libraries, and/or so forth. In some implementations, the components of the VR computer 120 can be configured to operate within a cluster of devices (e.g., a server farm). In such an implementation, the functionality and processing of the components of the VR computer 120 can be distributed to several devices of the cluster of devices.

The components of the VR computer 120 can be, or can include, any type of hardware and/or software configured to process attributes. In some implementations, one or more portions of the components shown in the components of the VR computer 120 in FIG. 1 can be, or can include, a hardware-based module (e.g., a digital signal processor (DSP), a field programmable gate array (FPGA), a memory), a firmware module, and/or a software-based module (e.g., a module of computer code, a set of computer-readable instructions that can be executed at a computer). For example, in some implementations, one or more portions of the components of the VR computer 120 can be, or can include, a software module configured for execution by at least one processor (not shown). In some implementations, the functionality of the components can be included in different modules and/or different components than those shown in FIG. 1.

Although not shown, in some implementations, the components of the user device 120 (or portions thereof) can be configured to operate within, for example, a data center (e.g., a cloud computing environment), a computer system, one or more server/host devices, and/or so forth. In some implementations, the components of the VR computer 120 (or portions thereof) can be configured to operate within a network. Thus, the components of the VR computer 120 (or portions thereof) can be configured to function within various types of network environments that can include one or more devices and/or one or more server devices. For example, the network can be, or can include, a local area network (LAN), a wide area network (WAN), and/or so forth. The network can be, or can include, a wireless network and/or wireless network implemented using, for example, gateway devices, bridges, switches, and/or so forth. The network can include one or more segments and/or can have portions based on various protocols such as Internet Protocol (IP) and/or a proprietary protocol. The network can include at least a portion of the Internet.

In some embodiments, one or more of the components of the VR computer 120 can be, or can include, processors configured to process instructions stored in a memory. For example, a LCD pixel row update manager 130 (and/or a portion thereof) and an illumination manager 140 can be a combination of a processor and a memory configured to execute instructions related to a process to implement one or more functions.

In some implementations, the memory 126 can be any type of memory such as a random-access memory, a disk drive memory, flash memory, and/or so forth. In some implementations, the memory 126 can be implemented as more than one memory component (e.g., more than one RAM component or disk drive memory) associated with the components of the VR computer 120. In some implementations, the memory 126 can be a database memory. In some implementations, the memory 126 can be, or can include, a non-local memory. For example, the memory 126 can be, or can include, a memory shared by multiple devices (not shown). In some implementations, the memory 126 can be associated with a server device (not shown) within a network and configured to serve the components of the VR computer 120. As illustrated in FIG. 1, the memory 126 is configured to store various data, including video frame data 132 and time interval data 142.

Figure 2:
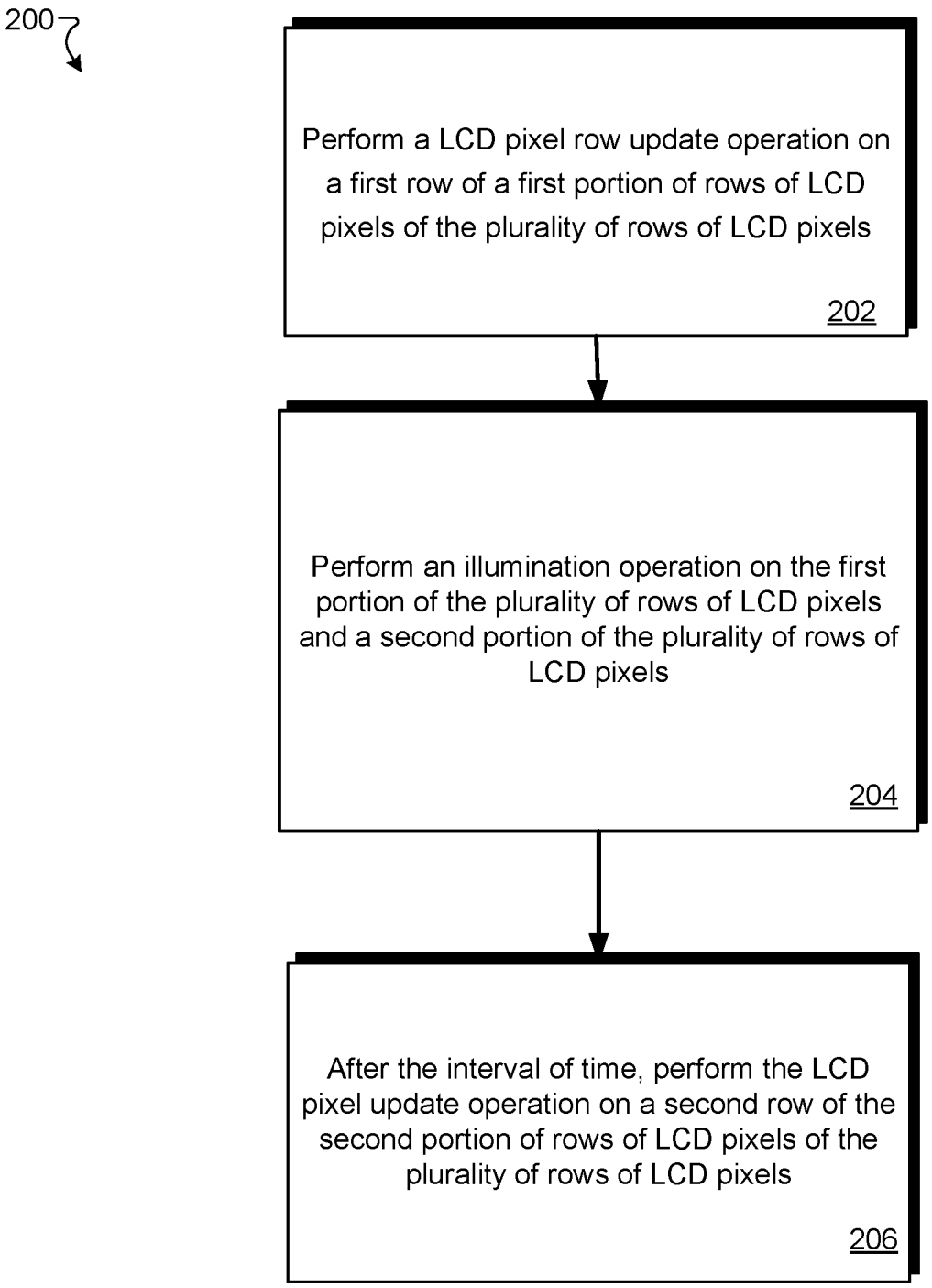
FIG. 2 is a flow chart that illustrates an example method of implementing the improved techniques as shown in FIG. 1.

FIG. 2 is a flow chart depicting an example method 200 of display video frames to a viewer via a plurality of rows of LCD pixels. The method 200 may be performed by software constructs described in connection with FIG. 1, which reside in memory 126 of the VR computer 120 and are run by the set of processing units 124.

At 202, the LCD pixel row update manager 130 performs a LCD pixel row update operation on a first row of a first portion of rows 116 of LCD pixels of the plurality of rows 114 of LCD pixels. The LCD pixel update operation produces, for the first row, one of a first state configured to block light from LCD pixels of that row of LCD pixels and a second state configured to allow light into LCD pixels of the first row.

At 204, the illumination manager 140 performs an illumination operation on the first portion 116 of the plurality of rows of LCD pixels and a second portion 118 of the plurality of rows of LCD pixels. The second portion 118 of the plurality of rows of LCD pixels is distinct from the first portion 116 of the plurality of rows of LCD pixels. The illumination operation triggers a production of light for each of the plurality of rows 114 of LCD pixels for an interval of time 142 during which the first row is updated.

At 206, after the interval of time, the LCD pixel row update manager 130 performs the LCD pixel update operation on a second row of the second portion 118 of rows of LCD pixels of the plurality of rows 114 of LCD pixels.

FIG. 3 is a diagram illustrating a plot 300 of updated pixel row vs. time for an example LCD display. The plot 300 shows a line 310 representing a number of pixel rows being updated as time passes. The plot 300 also shows a line 320 that is about parallel to the line 310. The line 320 represents a settling time of the TN liquid crystals of each of the LCD pixels. In this case, the LCD pixels are not illuminated until the TN liquid crystals of each of the LCD pixels has completed settling, resulting in a backlit illumination 330 being activated over a time interval 350 after a delay 340 caused by the settling time. After the backlit illumination 330 is deactivated, there is another cycle of updating represented by the line 360. In some implementations, the delay 340 is between 0.5 msec and 30 msec. In some implementations, the delay 340 is about 20 msec. In some implementations, the time interval 350 has a duration of between about 1 msec and 5 msec. The delay 340 effectively lowers the refresh rate of an LCD display that operates as illustrated in the plot 300.

The line 310 in the plot 300 is shown as a continuous line. In some implementations, the line 310 may be replaced by a staircase function, with each stair representing a row of the LCD pixel array. In this case, the temporal extent of each step is an update time period, i.e., the time it takes to update each row. Because the rows are updated sequentially, the update time periods form a sequence of update time periods.

FIG. 4 is a diagram illustrating a plot 400 of updated pixel row vs. time for another example LCD display. In this scenario, a backlit illumination 430 is activated during the updating of the LCD pixels, over a time interval 450, ending when the LCD pixels have completed settling. The next video frame may begin the updating of the LCD pixels as soon as the settling of the liquid crystal of the LCD pixels has completed; such a new cycle is shown as lines 460 and 470 and backlit illumination 432 at a new time interval 452. By activating the illumination during the updating, the refresh rate of the LCD display is increased over that for the LCD display whose illumination scheme is illustrated in FIG. 3. Nevertheless, activating the backlit illumination 430 during the updating causes ghosting in the images shown in the LCD display. That is, a viewer will see remnants of the previous video frame as the current video frame is shown.

Figure 5:
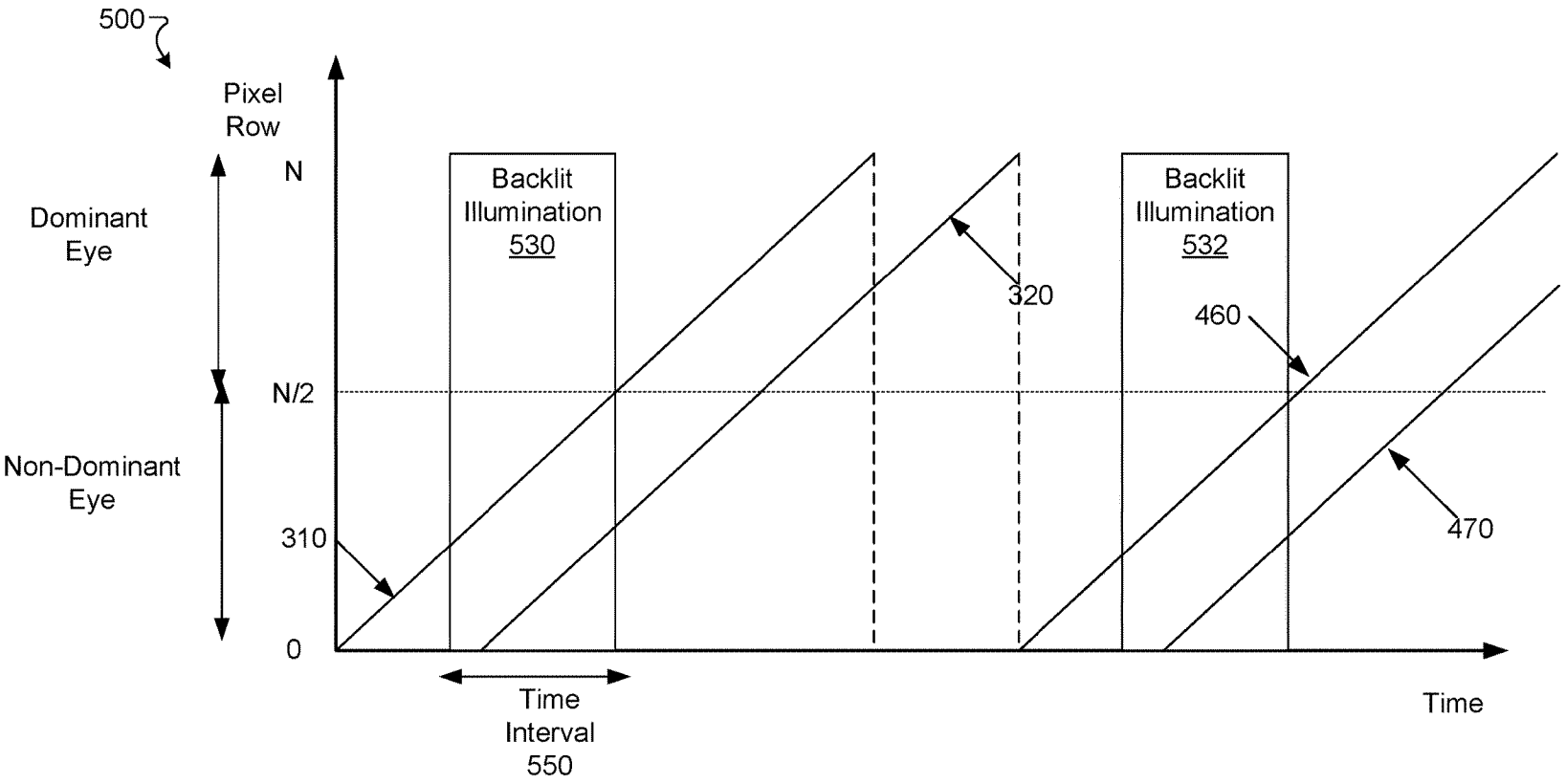
FIG. 5 is a diagram illustrating another example illumination scheme in which the refresh rate of an LCD configuration is improved and perceived ghosting is avoided.

FIG. 5 is a diagram illustrating a plot 500 of updated pixel row vs. time for another example LCD display. In this scenario, a backlit illumination 530 is activated during the updating of the LCD pixels, over a time interval 550. Nevertheless, the difference between the plot 500 and the plot 400 is that the time interval 550 is defined such that the backlit illumination 550 is deactivated once the pixels seen by the non-dominant eye have completed updating. The dominant eye, in contrast, only sees the current video frame and hence no ghosting. Because any ghosting caused by activated illumination 530 over the updating pixels corresponds to the non-dominant eye, the ghosting is effectively not perceived by the viewer.

One tradeoff in this scenario is that, because the time interval 550 has a shorter duration that that for the time interval 450 (FIG. 4), that there will be less overall brightness in the image. Nevertheless, the beginning of the time interval 550 can be adjusted so that the brightness of the image reaches an acceptable level. In some implementations, the illumination manager 140 can detect the level of brightness in the image and automatically make the adjustment of the time interval 550 based on the detected level of brightness.

Again, the line 310 may, in some implementations, be replaced by a staircase function as described with regard to FIG. 3. In this case, if one considers each of the updating of the rows corresponding to the non-dominant eye and the rows corresponding to the dominant eye as separate sequences, i.e., a first sequence and a second sequence, then the first updating period of the second sequence comes right after the last updating period of the first sequence.

If the rising edge of the backlit illumination 530 (i.e., when the light is activated) happens after the later rows (½ to max) have finished settling and the falling edge of the backlit illumination 530 (i.e., when the light is deactivated) happens before the middle of the scanout (row ½), the later rows (½ to max) won't experience ghosting. In some implementations, meeting both these criteria may make the pulse too short, affecting brightness. Accordingly, the phase (i.e., the begin time of the time interval 550) may need to be set so that some ghosting happens in the dominant eye half. Adjusting the begin time of the time interval 550) allows one to shift the balance of ghosting between the eyes.

The plot 500 further shows a second backlit illumination 532 being activated similarly as the backlit illumination 530. In some implementations, the second backlit illumination 532 is activated immediately after the settling of the LCD pixels.

The above examples assumed that the LCD displays were embedded within a HMD, such as the HMD 110 of FIG. 1. Nevertheless, in some implementations, the above LCD pixel updating and illumination scheme may be applied in areas other than VR. For example, the above-described updating and illumination scheme may be used in a standard LCD television viewing scenario.

The above examples showed the dominant eye being the right eye of the viewer 108. In some implementations, the dominant eye is the left eye. In this case, the backlit illumination pulse could be activated at a different time during the settling of the LCD pixels (e.g., toward the beginning).

Figure 6:
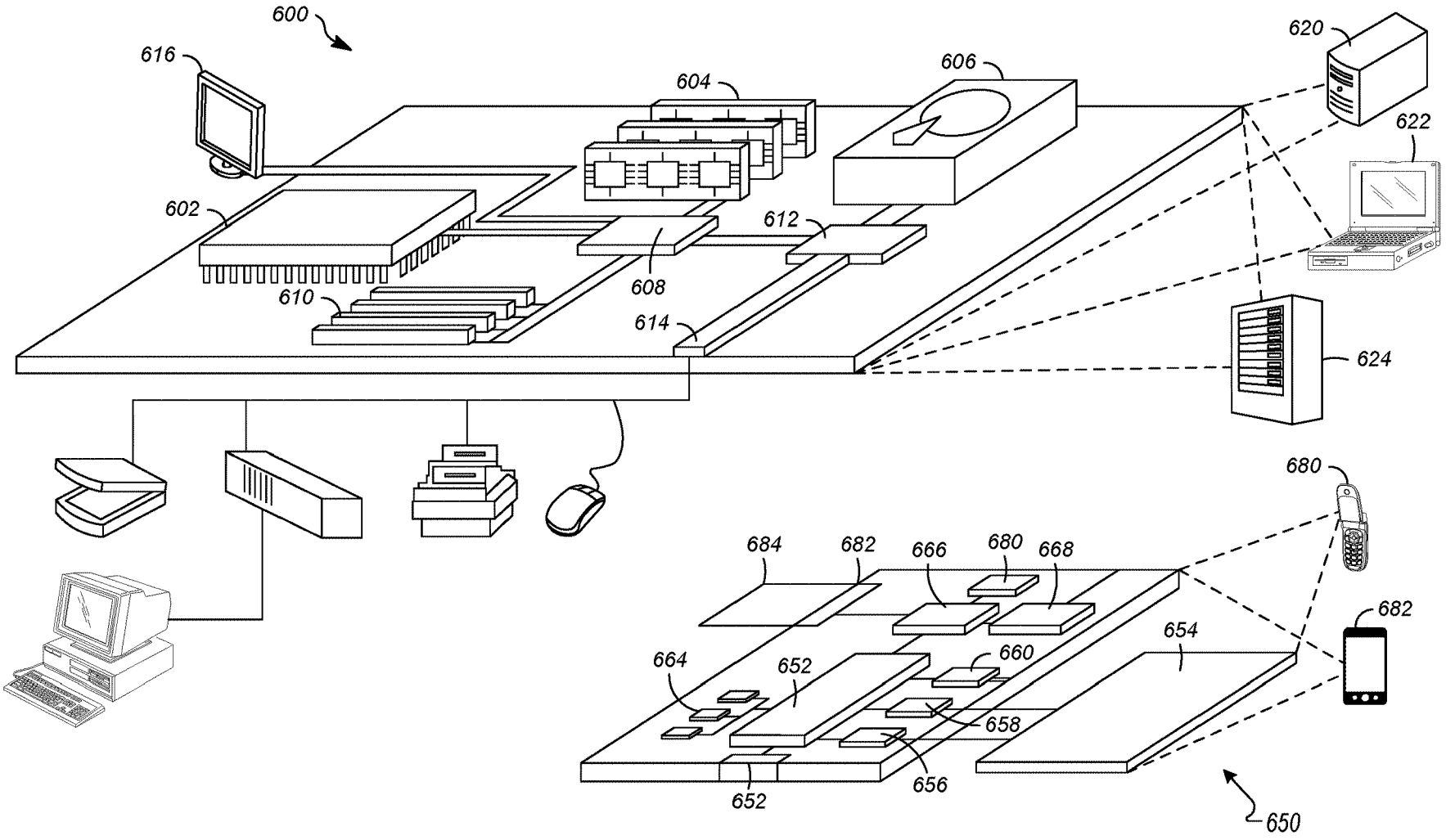
FIG. 6 illustrates an example of a computer device and a mobile computer device that can be used with circuits described here.

FIG. 6 illustrates an example of a generic computer device 600 and a generic mobile computer device 650, which may be used with the techniques described here.

As shown in FIG. 6, computing device 600 is intended to represent various forms of digital computers, such as laptops, desktops, workstations, personal digital assistants, servers, blade servers, mainframes, and other appropriate computers. Computing device 650 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

Computing device 600 includes a processor 602, memory 604, a storage device 606, a high-speed interface 608 connecting to memory 604 and high-speed expansion ports 610, and a low speed interface 612 connecting to low speed bus 614 and storage device 606. Each of the components 602, 604, 606, 608, 610, and 612, are interconnected using various busses, and may be mounted on a common motherboard or in other manners as appropriate. The processor 602 can process instructions for execution within the computing device 600, including instructions stored in the memory 604 or on the storage device 606 to display graphical information for a GUI on an external input/output device, such as display 616 coupled to high speed interface 608. In other implementations, multiple processors and/or multiple buses may be used, as appropriate, along with multiple memories and types of memory. Also, multiple computing devices 600 may be connected, with each device providing portions of the necessary operations (e.g., as a server bank, a group of blade servers, or a multi-processor system).

The memory 604 stores information within the computing device 600. In one implementation, the memory 604 is a volatile memory unit or units. In another implementation, the memory 604 is a non-volatile memory unit or units. The memory 604 may also be another form of computer-readable medium, such as a magnetic or optical disk.

The storage device 606 is capable of providing mass storage for the computing device 600. In one implementation, the storage device 606 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 604, the storage device 606, or memory on processor 602.

The high speed controller 608 manages bandwidth-intensive operations for the computing device 500, while the low speed controller 612 manages lower bandwidth-intensive operations. Such allocation of functions is exemplary only. In one implementation, the high-speed controller 608 is coupled to memory 604, display 616 (e.g., through a graphics processor or accelerator), and to high-speed expansion ports 610, which may accept various expansion cards (not shown). In the implementation, low-speed controller 612 is coupled to storage device 506 and low-speed expansion port 614. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 600 may be implemented in a number of different forms, as shown in the figure. For example, it may be implemented as a standard server 620, or multiple times in a group of such servers. It may also be implemented as part of a rack server system 624. In addition, it may be implemented in a personal computer such as a laptop computer 622. Alternatively, components from computing device 600 may be combined with other components in a mobile device (not shown), such as device 650. Each of such devices may contain one or more of computing device 600, 650, and an entire system may be made up of multiple computing devices 600, 650 communicating with each other.

Computing device 650 includes a processor 652, memory 664, an input/output device such as a display 654, a communication interface 666, and a transceiver 668, among other components. The device 650 may also be provided with a storage device, such as a microdrive or other device, to provide additional storage. Each of the components 650, 652, 664, 654, 666, and 668, are interconnected using various buses, and several of the components may be mounted on a common motherboard or in other manners as appropriate.

The processor 652 can execute instructions within the computing device 650, including instructions stored in the memory 664. The processor may be implemented as a chipset of chips that include separate and multiple analog and digital processors. The processor may provide, for example, for coordination of the other components of the device 650, such as control of user interfaces, applications run by device 650, and wireless communication by device 650.

Processor 652 may communicate with a user through control interface 658 and display interface 656 coupled to a display 654. The display 654 may be, for example, a TFT LCD (Thin-Film-Transistor Liquid Crystal Display) or an OLED (Organic Light Emitting Diode) display, or other appropriate display technology. The display interface 656 may comprise appropriate circuitry for driving the display 654 to present graphical and other information to a user. The control interface 658 may receive commands from a user and convert them for submission to the processor 652. In addition, an external interface 662 may be provided in communication with processor 652, so as to enable near area communication of device 650 with other devices. External interface 662 may provide, for example, for wired communication in some implementations, or for wireless communication in other implementations, and multiple interfaces may also be used.

The memory 664 stores information within the computing device 650. The memory 664 can be implemented as one or more of a computer-readable medium or media, a volatile memory unit or units, or a non-volatile memory unit or units. Expansion memory 674 may also be provided and connected to device 650 through expansion interface 672, which may include, for example, a SIMM (Single In Line Memory Module) card interface. Such expansion memory 674 may provide extra storage space for device 650, or may also store applications or other information for device 650. Specifically, expansion memory 674 may include instructions to carry out or supplement the processes described above, and may include secure information also. Thus, for example, expansion memory 674 may be provided as a security module for device 650, and may be programmed with instructions that permit secure use of device 650. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 664, expansion memory 674, or memory on processor 652, that may be received, for example, over transceiver 668 or external interface 662.

Device 650 may communicate wirelessly through communication interface 666, which may include digital signal processing circuitry where necessary. Communication interface 666 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 668. In addition, short-range communication may occur, such as using a Bluetooth, WiFi, or other such transceiver (not shown). In addition, GPS (Global Positioning System) receiver module 670 may provide additional navigation- and location-related wireless data to device 650, which may be used as appropriate by applications running on device 650.

Device 650 may also communicate audibly using audio codec 660, which may receive spoken information from a user and convert it to usable digital information. Audio codec 660 may likewise generate audible sound for a user, such as through a speaker, e.g., in a handset of device 650. Such sound may include sound from voice telephone calls, may include recorded sound (e.g., voice messages, music files, etc.) and may also include sound generated by applications operating on device 650.

The computing device 650 may be implemented in a number of different forms, as shown in the figure. For example, it may be implemented as a cellular telephone 680. It may also be implemented as part of a smart phone 682, personal digital assistant, or other similar mobile device.

Figure 7:
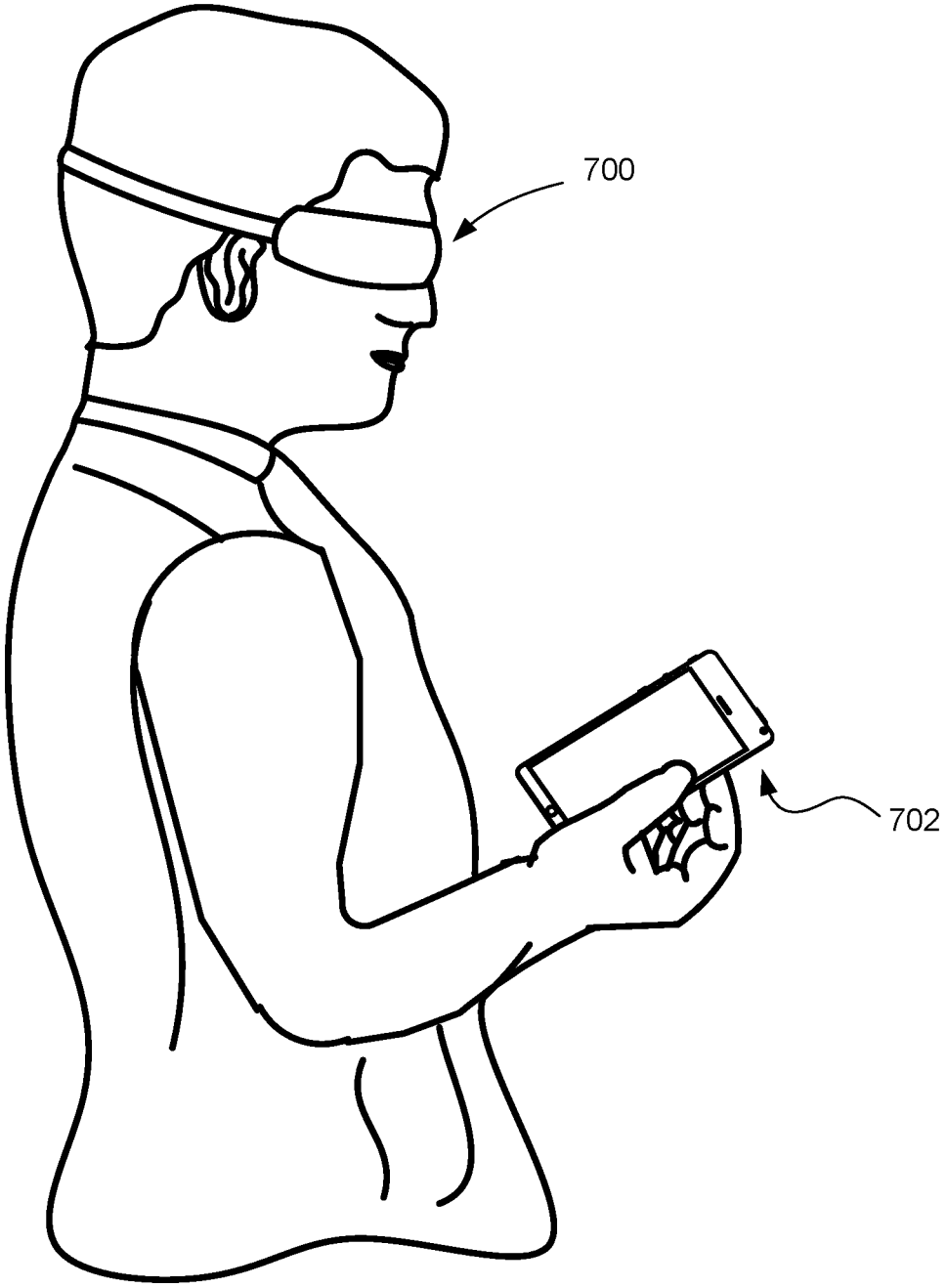
FIG. 7 is a diagram depicting an example VR head-mounted display (HMD).

FIG. 7 illustrates an example implementation of a head-mounted display as shown in FIGS. 3 and 5. In FIG. 7, a user wearing an HMD 700 is holding a portable handheld electronic device 702. The handheld electronic device 702 may be, for example, a smartphone, a controller, a joystick, or another portable handheld electronic device(s) that may be paired with, and communicate with, the HMD 700 for interaction in the immersive virtual environment generated by the HMD 700. The handheld electronic device 702 may be operably coupled with, or paired with the HMD 700 via, for example, a wired connection, or a wireless connection such as, for example, a WiFi or Bluetooth connection. This pairing, or operable coupling, of the handheld electronic device 702 and the HMD 700 may provide for communication between the handheld electronic device 702 and the HMD 700 and the exchange of data between the handheld electronic device 702 and the HMD 700. This may allow the handheld electronic device 602 to function as a controller in communication with the HMD 700 for interacting in the immersive virtual environment generated by the HMD 700. That is, a manipulation of the handheld electronic device 702, such as, for example, a beam or ray emitted by the handheld electronic device 702 and directed to a virtual object or feature for selection, and/or an input received on a touch surface of the handheld electronic device 702, and/or a movement of the handheld electronic device 702, may be translated into a corresponding selection, or movement, or other type of interaction, in the immersive virtual environment generated by the HMD 700. For example, the HMD 700, together with the handheld electronic device 702, may generate a virtual environment as described above, and the handheld electronic device 702 may be manipulated to effect a change in scale, or perspective, of the user relative to the virtual features in the virtual environment as described above.

Figure 8A:
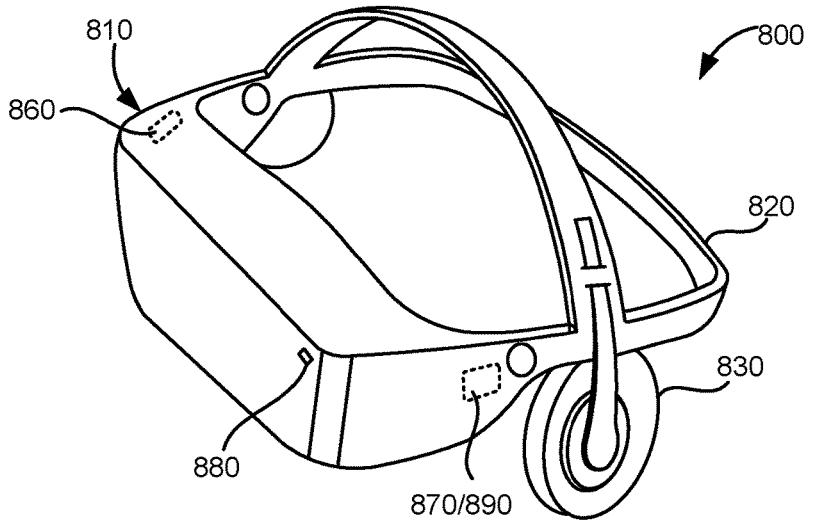
FIGS. 8A, 8B, and 8C are diagrams depicting the example VR HMD and controller.
Figure 8B:
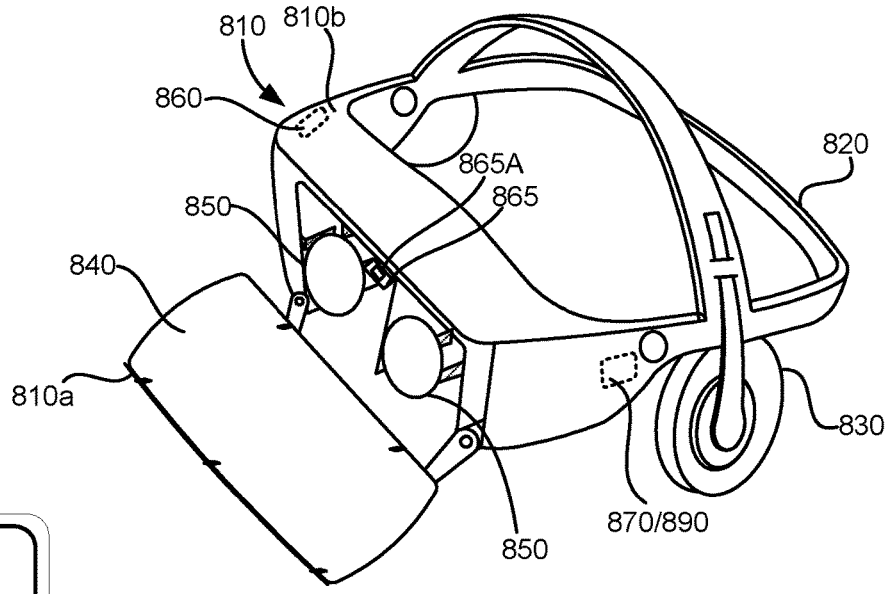
Figure 8C:
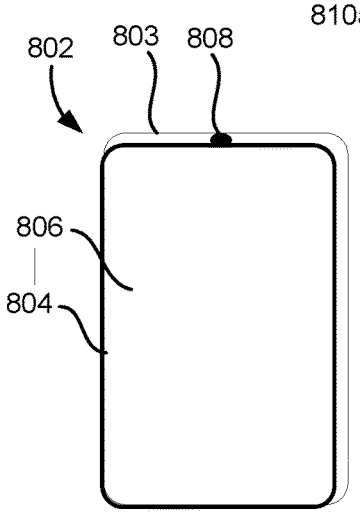

FIGS. 8A and 8B are perspective views of an example HMD, such as, for example, the HMD 700 worn by the user in FIG. 7, and FIG. 8C illustrates an example handheld electronic device, such as, for example, the handheld electronic device 702 shown in FIG. 7.

The handheld electronic device 802 may include a housing 803 in which internal components of the device 802 are received, and a user interface 804 on an outside of the housing 803, accessible to the user. The user interface 804 may include a touch sensitive surface 806 configured to receive user touch inputs. The user interface 804 may also include other components for manipulation by the user such as, for example, actuation buttons, knobs, joysticks and the like. In some implementations, at least a portion of the user interface 804 may be configured as a touchscreen, with that portion of the user interface 804 being configured to display user interface items to the user, and also to receive touch inputs from the user on the touch sensitive surface 806. The handheld electronic device 802 may also include a light source 808 configured to selectively emit light, for example, a beam or ray, through a port in the housing 803, for example, in response to a user input received at the user interface 804.

The HMD 800 may include a housing 810 coupled to a frame 820, with an audio output device 830 including, for example, speakers mounted in headphones, also be coupled to the frame 820. In FIG. 8B, a front portion 810*a* of the housing 810 is rotated away from a base portion 810*b* of the housing 810 so that some of the components received in the housing 810 are visible. A display 840 may be mounted on an interior facing side of the front portion 810*a* of the housing 810. Lenses 850 may be mounted in the housing 810, between the user's eyes and the display 840 when the front portion 810*a* is in the closed position against the base portion 810*b* of the housing 810. In some implementations, the HMD 800 may include a sensing system 860 including various sensors and a control system 870 including a processor 890 and various control system devices to facilitate operation of the HMD 800.

In some implementations, the HMD 800 may include a camera 880 to capture still and moving images. The images captured by the camera 880 may be used to help track a physical position of the user and/or the handheld electronic device 802 in the real world, or physical environment relative to the virtual environment, and/or may be displayed to the user on the display 840 in a pass through mode, allowing the user to temporarily leave the virtual environment and return to the physical environment without removing the HMD 800 or otherwise changing the configuration of the HMD 800 to move the housing 810 out of the line of sight of the user.

In some implementations, the HMD 800 may include a gaze tracking device 865 to detect and track an eye gaze of the user. The gaze tracking device 865 may include, for example, an image sensor 865A, or multiple image sensors 865A, to capture images of the user's eyes, for example, a particular portion of the user's eyes, such as, for example, the pupil, to detect, and track direction and movement of, the user's gaze. In some implementations, the HMD 800 may be configured so that the detected gaze is processed as a user input to be translated into a corresponding interaction in the immersive virtual experience.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

A number of embodiments have been described. Nevertheless, it will be understood that various modifications may be made without departing from the spirit and scope of the specification.

It will also be understood that when an element is referred to as being on, connected to, electrically connected to, coupled to, or electrically coupled to another element, it may be directly on, connected or coupled to the other element, or one or more intervening elements may be present. In contrast, when an element is referred to as being directly on, directly connected to or directly coupled to another element, there are no intervening elements present. Although the terms directly on, directly connected to, or directly coupled to may not be used throughout the detailed description, elements that are shown as being directly on, directly connected or directly coupled can be referred to as such. The claims of the application may be amended to recite exemplary relationships described in the specification or shown in the figures.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or subcombinations of the functions, components and/or features of the different implementations described.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

What is claimed is:

1. A method, comprising:

performing, by controlling circuitry of a processor configured to display video frames to a viewer via a plurality of rows of liquid crystal display (LCD) pixels, a LCD pixel row update operation on a first row of a first portion of rows of LCD pixels of the plurality of rows of LCD pixels, the LCD pixel update operation producing, for the first row, one of a first state configured to block light from LCD pixels of the first row and a second state configured to allow light into LCD pixels of the first row;

performing, by the controlling circuitry, an illumination operation on the first portion of the plurality of rows of LCD pixels and a second portion of the plurality of rows of LCD pixels, the second portion of the plurality of rows of LCD pixels being distinct from the first portion of the plurality of rows of LCD pixels, the illumination operation triggering a production of light for each of the plurality of rows of LCD pixels for an interval of time during which the first row is updated; and after the interval of time, performing, by the controlling circuitry, the LCD pixel update operation on a second row of the second portion of rows of LCD pixels of the plurality of rows of LCD pixels, wherein the first portion of the plurality of rows of LCD pixels are within a field of view (FOV) of a non-dominant eye of a viewer and the second portion of the plurality of rows of LCD pixels are within a field of view of a dominant eye of the viewer.

2. The method of claim 1, further comprising:

receiving dominant eye indication data indicating whether a left eye or a right eye of the viewer is the dominant eye.

3. The method of claim 1, wherein the plurality of rows of LCD pixels are displayed within a head-mounted display (HMD) of a virtual reality (VR) system, the VR system including the processor.

4. The method of claim 1, wherein the interval of time has a time duration between 1 msec and 5 msec.

5. The method of claim 1, further comprising:

receiving feedback data indicating that the viewer perceives a ghost image in a displayed video frame; and in response to the feedback data, adjusting the interval of time to begin at a different instant of time.

6. The method of claim 1, further comprising:

receiving feedback data indicating that the viewer perceives a ghost image in a displayed video frame; and in response to the feedback data, adjusting a time duration of the interval of time.

7. The method of claim 1, further comprising:

adjusting the time interval based on a detected level of brightness over the plurality of rows of LCD pixels.

8. A computer program product comprising a nontransitory storage medium, the computer program product including code that, when executed by processing circuitry of a user device configured to display video frames to a viewer via a plurality of rows of liquid crystal display (LCD) pixels, causes the processing circuitry to perform a method, the method comprising:

performing a LCD pixel row update operation on each of a first portion of rows of LCD pixels of the plurality of rows of LCD pixels, the LCD pixel update operation producing, for a first row, one of a first state configured to block light from LCD pixels of the first row and a second state configured to allow light into LCD pixels of the first row;

performing an illumination operation on the first portion of the plurality of rows of LCD pixels and a second portion of the plurality of rows of LCD pixels, the second portion of the plurality of rows of LCD pixels being distinct from the first portion of the plurality of rows of LCD pixels, the illumination operation triggering a production of light for each of the plurality of rows of LCD pixels for an interval of time during which the first row is updated; and after the interval of time, performing the LCD pixel update operation on a second row of the second portion of rows of LCD pixels of the plurality of rows of LCD pixels, wherein the first portion of the plurality of rows of LCD pixels are within a field of view (FOV) of a non-dominant eye of a viewer and the second portion of the plurality of rows of LCD pixels are within a field of view of a dominant eye of the viewer.

9. The computer program product of claim 8, wherein the method further comprises:

receiving dominant eye indication data indicating whether a left eye or a right eye of the viewer is the dominant eye.

10. The computer program product of claim 8, wherein the plurality of rows of LCD pixels are displayed within a head-mounted display (HMD) of a virtual reality (VR) system, the VR system including the processor.

11. The computer program product of claim 8, wherein the interval of time has a time duration between 1 msec and 5 msec.

12. The computer program product of claim 8, wherein the method further comprises:

receiving feedback data indicating that the viewer perceives a ghost image in a displayed video frame; and in response to the feedback data, adjusting the interval of time to begin at a different instant of time.

13. The computer program product of claim 8, wherein the method further comprises:

receiving feedback data indicating that the viewer perceives a ghost image in a displayed video frame; and in response to the feedback data, adjusting a time duration of the interval of time.

14. An electronic apparatus configured to display video frames to a viewer via a plurality of rows of LCD pixels, the electronic apparatus comprising:

memory; and controlling circuitry coupled to the memory, the controlling circuitry being configured to:

perform a liquid crystal display (LCD) pixel row update operation on a first row of a first portion of rows of LCD pixels of the plurality of rows of LCD pixels, the LCD pixel update operation producing, for the first row, one of a first state configured to block light from LCD pixels of the first row and a second state configured to allow light into LCD pixels of the first row;

perform an illumination operation on the first portion of the plurality of rows of LCD pixels and a second portion of the plurality of rows of LCD pixels, the second portion of the plurality of rows of LCD pixels being distinct from the first portion of the plurality of rows of LCD pixels, the illumination operation triggering a production of light for each of the plurality of rows of LCD pixels for an interval of time during which the first row is updated; and after the interval of time, perform the LCD pixel update operation on a second row of the second portion of rows of LCD pixels of the plurality of rows of LCD pixels, wherein the first portion of the plurality of rows of LCD pixels are within a field of view (FOV) of a non-dominant eye of a viewer and the second portion of the plurality of rows of LCD pixels are within a field of view of a dominant eye of the viewer.

15. The electronic apparatus of claim 14, wherein the controlling circuitry is further configured to:

receive dominant eye indication data indicating whether a left eye or a right eye of the viewer is the dominant eye.

* * * * *